US006631816B1

(12) United States Patent
Miyazawa et al.

(10) Patent No.: US 6,631,816 B1
(45) Date of Patent: Oct. 14, 2003

(54) HOIST

(75) Inventors: Isao Miyazawa, Urawa (JP); Hiroshi Asano, Tokyo-to (JP); Kunio Noui, Tokyo-to (JP)

(73) Assignee: Ishikawajima-Harima Jukogyo Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 09/479,992

(22) Filed: Jan. 10, 2000

(30) Foreign Application Priority Data

| | | |
|---|---|---|
| Mar. 18, 1999 | (JP) | 11-073553 |
| Apr. 5, 1999 | (JP) | 11-097421 |
| Apr. 16, 1999 | (JP) | 11-109411 |
| Jul. 1, 1999 | (JP) | 11-187792 |

(51) Int. Cl.[7] ..... B66C 13/06; B66D 1/14

(52) U.S. Cl. ..... 212/272; 212/271; 212/273; 254/344

(58) Field of Search ..... 212/272–275, 212/312, 315, 316, 317, 321, 323, 324, 225, 227, 257; 254/344

(56) References Cited

U.S. PATENT DOCUMENTS

| | | | | | |
|---|---|---|---|---|---|
| 1,488,286 | A | * | 3/1924 | Richter | 254/344 |
| 1,578,965 | A | * | 3/1926 | Eck | 254/344 |
| 3,743,107 | A | * | 7/1973 | Verschoof | 212/274 |
| 4,214,664 | A | * | 7/1980 | Polen | 212/274 |
| 4,328,954 | A | * | 5/1982 | Logus | 254/344 |
| 4,483,518 | A | * | 11/1984 | Geschwind | 254/344 |
| 4,905,848 | A | * | 3/1990 | Skjonberg | 212/274 |
| 5,860,635 | A | | 1/1999 | Morfitt et al. | |
| 6,182,843 | B1 | * | 2/2001 | Tax et al. | 212/275 |

FOREIGN PATENT DOCUMENTS

| | | | | |
|---|---|---|---|---|
| GB | 731009 | * | 6/1955 | 254/344 |
| GB | 2140764 | * | 12/1984 | 254/344 |
| JP | 11-246169 | | 9/1999 | |

* cited by examiner

*Primary Examiner*—Kathy Matecki
*Assistant Examiner*—R. B. Johnson
(74) *Attorney, Agent, or Firm*—Oblon, Spivak, McClelland, Maier & Neustadt, P.C.

(57) ABSTRACT

Drums each having an independent drive source is installed on a trolley and each of the drums has a lifting rope which is wound around it and has an unwound end locked on a suspension piece, which will suppress any need to design the lifting rope in longer length and the drums in larger size.

Sun gears, carriers and planetary gears disposed in each of the drums as well as internal teeth in each of the drums so as to be integrally rotated with the drum constitute a speed reducing mechanism for transmitting rotation of a drive source to each of the drums, will enable the entire hoist to be compact in size.

Unwound length of the lifting rope from each drum is adjusted to control posture of the suspension piece and load in adequate state.

1 Claim, 16 Drawing Sheets

HOIST

BACKGROUND OF THE INVENTION

The present invention relates to a hoist used in a container crane.

FIG. 1 shows a container crane and FIG. 2 illustrates a boom derrick, a head block lifter and a trolley traverser used in the container crane. More specifically, the container crane comprises land- and seaward rails Q1 and Q2 on a quay P at harbor S, a traveler 2 with legs 1*a* and 1*b* running on the rails Q1 and Q2, a girder 3 substantially horizontally mounted on a top of the traveler 2, a boom 4 pivoted to a tip of the girder 3 so as to be swung upward, a main trolley 5 traversing along the girder 3 and boom 4, a head block 6 suspended from and vertically movable relative to the trolley 5, a spreader 7 mounted on the block 6 and with which a container C is to be locked, a first catenary trolley 19 positioned closer to a base end of the girder 3 than the main trolley 5 and traversing along the girder 3 and boom 4 and a second catenary trolley 20 positioned closer to the tip of the boom 4 than the main trolley 5 and traversing along the girder 3 and boom 4.

In the container crane as described above, unloading of the container C from a ship V to the quay P and loading of the same from the quay P to the ship V are carried out in combination of operations such as motion of the traveler 2 along the quay P, traverse of the trolley 5 on the girder 3 and boom 4, vertical motion of the block 6 relative to the trolley 5 and locking of the container C by the spreader 7.

Disposed on the girder 3 is a machine room 8 with a drum 11 for derricking motion of the boom 4, drums 15*a* and 15*b* for vertical motion of the block 6, a drum 13 for traverse of the main trolley 5 and drums 9*a* and 9*b* for traverse of the catenary trolleys 19 and 20.

Rotation of the drum 11 in normal and reverse directions causes a boom-derricking rope 12 to be wound and unwound, respectively, resulting in change of angle of the boom 4 to the girder 3.

Rotation of the drums 15*a* and 15*b* in normal and reverse directions causes block-lifting ropes 16*a* and 16*b* to be wound and unwound, respectively, resulting in vertical motion of the block 6 relative to the trolley 5.

Rotation of the drum 13 in normal and reverse directions causes trolley-traversing ropes 14*a* and 14*b* to be wound and unwound, resulting in traverse of the trolley 5 towards the base and tip ends of the boom 4, respectively, since the rope 14*a* is locked at its opposite ends to the drum 13 and engaged at its intermediate portion with the trolley 5 via the base end of the girder 3 and the rope 14*b* is locked at its opposite ends to the drum 13 and engaged at its intermediate portion with the trolley 5 via the tip of the boom 4.

Rotation of the drums 9*a* and 9*b* in normal.and reverse directions causes trolley-traversing ropes 10*a* and 10*b* to be wound and unwound, resulting in traverse of the trolleys 19 and 20 towards the base and tip ends of the boom 4, respectively, since the rope 10*a* is locked at its opposite ends to the drums 9*a* and 9*b* and engaged at its intermediate portion with the trolley 19 via the base end of the girder 3 and the rope 10*b* is locked at its opposite ends to the drums 9*a* and 9*b* and engaged at its intermediate portion with the trolley 20 via the tip of the boom 4 and since the trolleys 19 and 20 are interconnected through a rope 17.

The catenary-trolley drums 9*a* and 9*b* are adapted to be rotated in synchronization with rotation of the main-trolley drum 13. The first catenary trolley 19 follows after the main trolley 5 so as to be positioned intermediately between the base end of the girder 3 and the trolley 5. The second catenary trolley 20 follows after the main trolley 5 so as to be positioned intermediately between the tip end of the boom 4 and the trolley 5.

The catenary trolleys 19 and 20 have rollers (not shown) pivoted to the trolleys 19 and 20 to support the main-trolley-traversing ropes 14*a* and 14*b* from below, respectively. The roller pivoted to the trolley 19 serves to suppress any excessive loosening of the rope 14*a* between the base end of the girder 3 and the trolley 5. The roller pivoted to the trolley 20 serves to suppress any excessive loosening of the rope 14*b* between the tip of the boom 4 and the trolley 5.

In recent years, there is a trend of increased traverse distance of the main trolley 5 as well as increased lift of the head block 6 in such container crane in association with a tendency of building larger-sized ships V.

In the conventional container crane, however, the block-lifting ropes 16*a* and 16*b* are wound on sheaves 18 pivotally supported at four corners of the block 6 to have eight turns in total so as to suspend the block 6 from the trolley 5. Therefore, increased traverse distance of the main trolley 5 and/or increased lift of the head block 6 will lead to prolongation of the block-lifting ropes 16*a* and 16*b* and increase in size of the block-lifting drums 15*a* and 15*b*. This may disadvantageously result in increase in weight of the system above the traveler 2 and/or difficulties in maintenance and inspection of the ropes 16*a* and 16*b*.

The present invention was made to solve the above problems and has its major object to provide a hoist which is light in weight and compact in size.

BRIEF SUMMARY OF THE INVENTION

According to a hoist of the invention drums with independent drive sources are mounted on a trolley and an unwound end of the head-block-lifting rope wound around each of the drums is locked on a suspension piece of a container, which suppress any need of the ropes in longer length and the drums in larger size.

According to a hoist of the invention sun gears, carriers and planetary gears in each of the drums as well as internal teeth in each of the drums for integral rotation with the drum provide a speed reducing mechanism for transmitting rotation of the drive source to the drum, which contributes to make the entire hoist compact in size.

According to a hoist of the invention provided between two drums is a differential gear mechanism for transmitting rotation of drums to an output shaft. Rotation of a drive shaft of the differential gear mechanism may be suppressed to synchronize rotation of the two drums.

According to a hoist of the invention provided between two drums is a differential gear mechanism for transmitting rotation of the two drums to an output shaft. The drive shaft of the differential gear mechanism is rotated to vary rotation of the two drums relatively to each other.

According to a hoist of the invention when the trolley is to be accelerated, a link is displaced in position in a predetermined direction by an actuator. The positional displacement of the link is transmitted to two paired drums via torque arms so that the drums positioned,ahead in the moving direction of the trolley are rotated in rope-winding direction and the drums positioned behind in the moving direction of the trolley are rotated in rope-unwinding direction. As a result, tensions on the ropes at positions ahead and behind in the moving direction of the trolley are adjusted to apply a force directed in the moving direction of the trolley on the suspension piece.

When the trolley is to be decelerated, the link is displaced in position in a direction opposite to the direction during the acceleration. The positional displacement of the link is transmitted to the two paired drums via the torque arms. The drums positioned ahead in the moving direction of the trolley are rotated in rope-unwinding direction and the drums positioned behind in the moving direction of the trolley are rotated in rope-winding direction. As a result, tensions on the ropes positioned ahead and behind in the moving direction of the trolley are adjusted to apply a force directed in a direction opposite to the moving direction of the trolley on the suspension piece of the container.

DETAILED DESCRIPTION OF THE PREFERRED EMBODIMENTS

Embodiments of the invention will be described in conjunction with the attached drawings.

Figure 1:
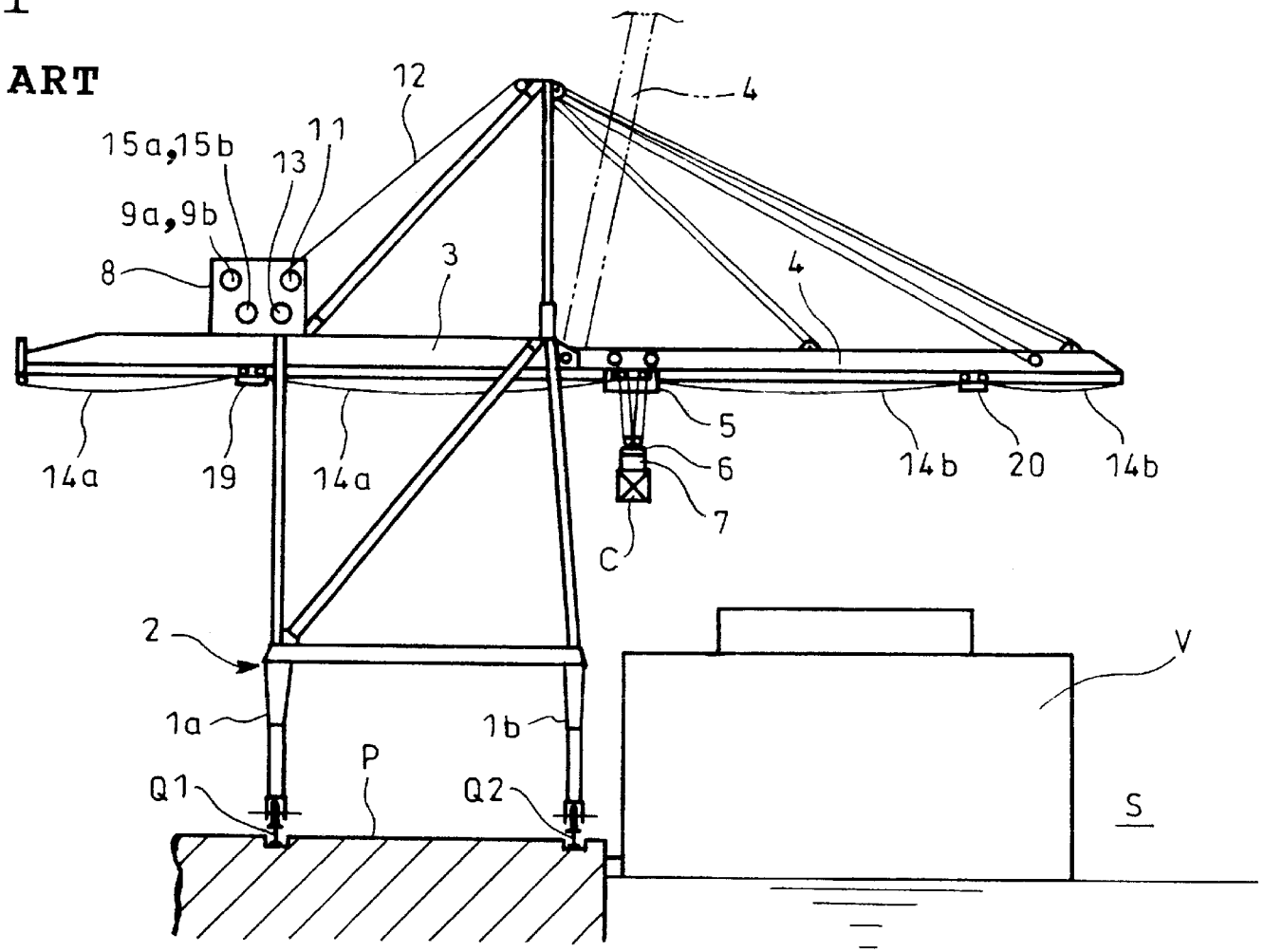
FIG. 1 PRIOR ART
FIG. 1 is a general, side elevation showing a container crane.
Figure 2:
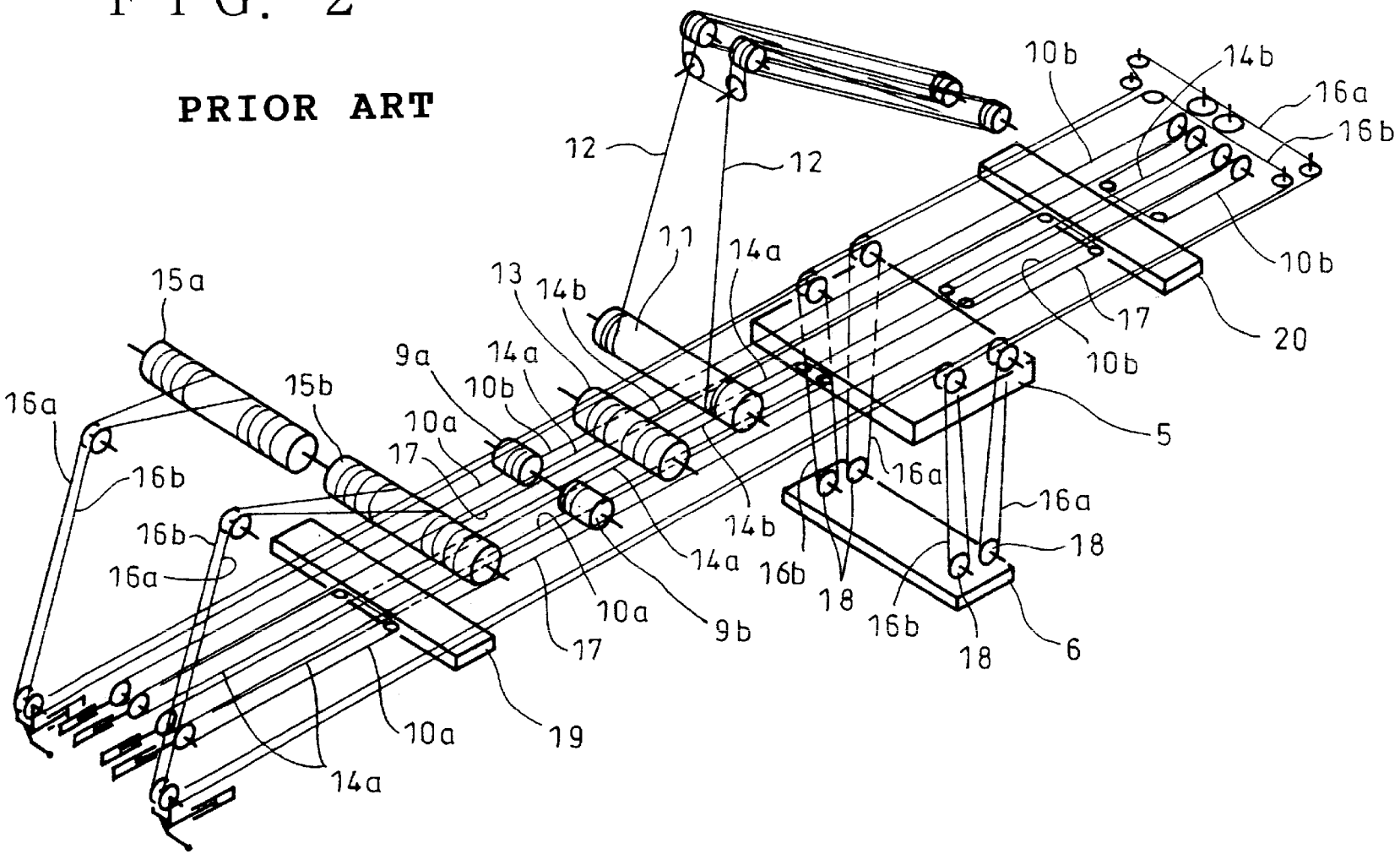
FIG. 2 PRIOR ART
FIG. 2 is,a perspective view showing a head block lift, a boom derrick and a trolley traverser relating to the container crane shown in FIG. 1.
Figure 3:
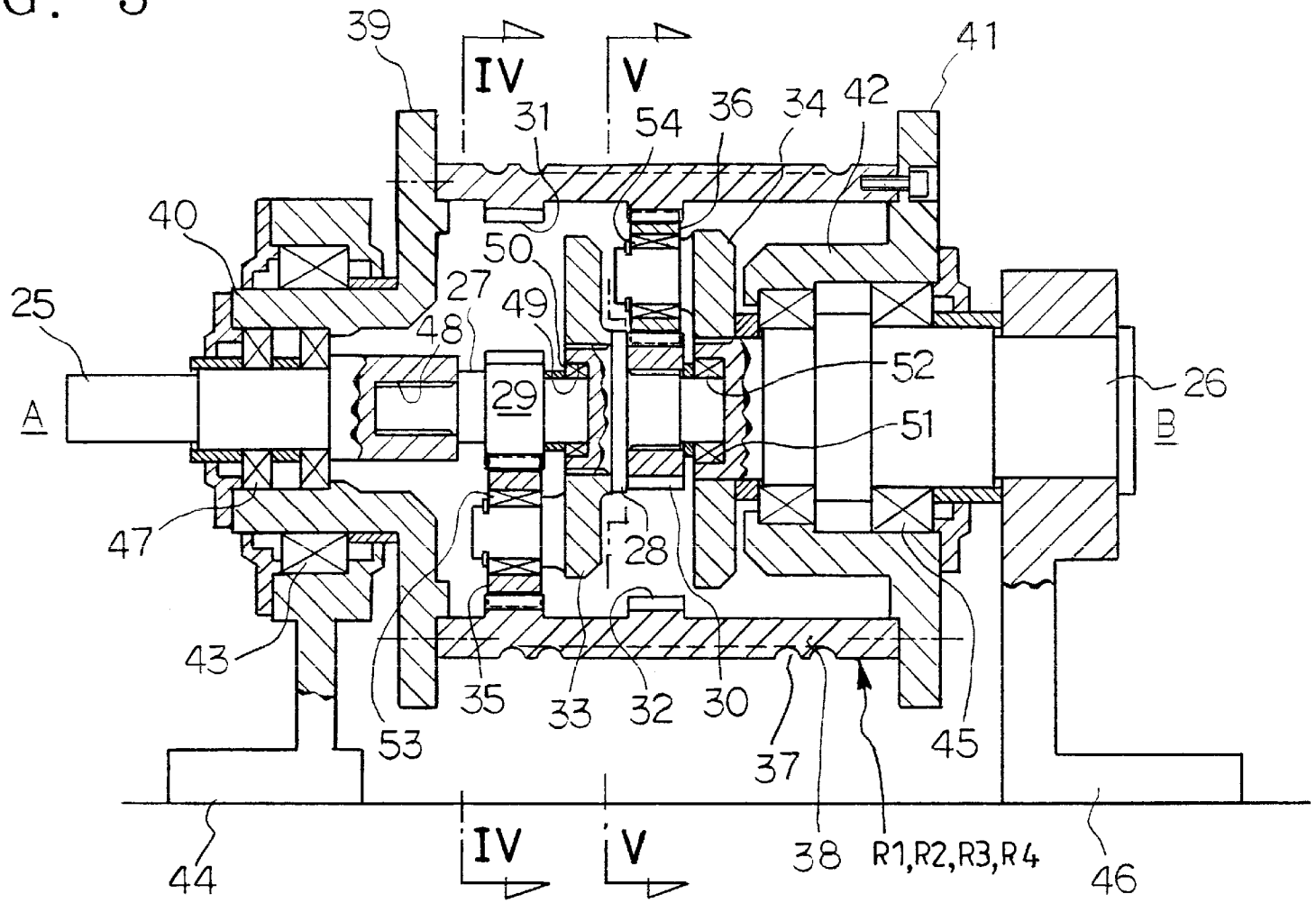
FIG. 3 is a sectional view of a drum in a first embodiment of the invention.

FIGS. 3 to 8 represent a first embodiment of the invention in which the same components as in FIGS. 1 and 2 are referred to by the same reference numerals.

The hoist comprises first, second, third and fourth hollow drums R1, R2, R3 and R4 each having opposite openings on opposite sides A and B, a drive shaft 25 extending through one of the openings and a fixed shaft 26 extending through the other opening coaxially of the shaft 25. Each of the drums further has therein first and second rotation shafts 27 and 28, first and second sun gears 29 and 30, first and second internal teeth 31 and 32, first and second carriers 33 and 34 and first and second planetary gears 35 and 36.

Each of the drums R1, R2, R3 and R4 comprises a cylindrical drum body 38 which extends substantially horizontally and which has a rope groove 37 formed on an outer surface of the drum body 38, a flange 39 coaxially bolted to an end surface of the drum body 38 facing to the side A, a cylindrical journal 40 contiguous with the flange 39 and coaxially extending outwardly of the drum body 38, a flange 41 coaxially bolted to the other end surface of the drum body 38 facing to the other side B and a cylindrical hub 42 contiguous with the flange 41 and coaxially extending inwardly of the drum body 38.

The drum body 38 is peripherally rotatably supported by a bearing 43 which circumscribes the journal 40, a bracket 44 on which the bearing 43 is mounted, a bearing 45 which inscribes the hub 42 and circumscribes the fixed shaft 26 and a bracket 46 to which the shaft 26 is fixed.

The journal 40 is inscribed via a bearing 47 by the drive shaft 25.

The drive shaft 25 is connected at its one end facing to the side A with an output shaft of a drive source 57 such as a motor.

The drive shaft 25 is formed at its other end facing to the other side B with a recess 48 into which the first rotation shaft 27 is coaxially fitted at its end facing to the side A. The rotation shaft 27 is coaxially fitted at its other end facing to the other side B, via a bearing 50, into a recess 49 on an end of the rotation shaft 28 facing to the side A. Thus, the drive shaft 25 and rotation shaft 27 can be peripherally rotated relative to the drum body and to the rotation shaft 28.

The rotation shaft 28 is fitted at its other end facing to the side B, via a bearing 52, into a recess 51 on an end of the fixed shaft 26 facing to the side A. Thus, the rotation shaft 28 can be peripherally rotated relative to the rotation and fixed shafts 27 and 26.

The sun gears 29 and 30 are fitted over intermediate portions of the rotation shafts 27 and 28, respectively.

The internal teeth 31 and 32 are formed on an inner surface of the drum body 38 to peripherally surround the sun gears 29 and 30, respectively.

The first carrier 33 is disposed on the side B with respect to the first sun gear 29 and is fitted into an end of the second rotation shaft 28 facing to the side A so that the carrier 33 can be rotated together with the rotation shaft 28 relative to the drum body.

The second carrier 34 is disposed on the side B with respect to the second sun gear 30 and is fitted into an end of the fixed shaft 26 facing to the side A.

Figure 4:
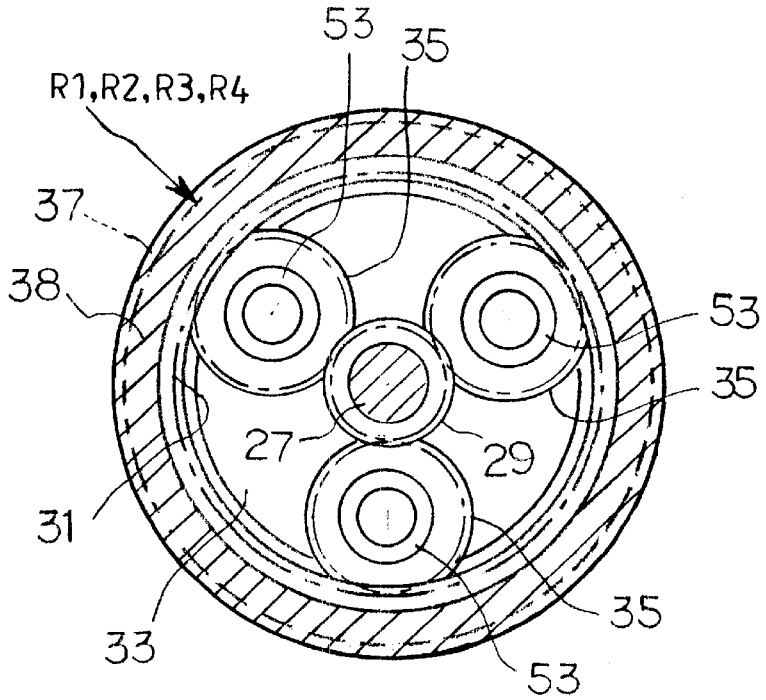
FIG. 4 is a view looking in the direction of arrows IV in FIG. 3.
Figure 5:
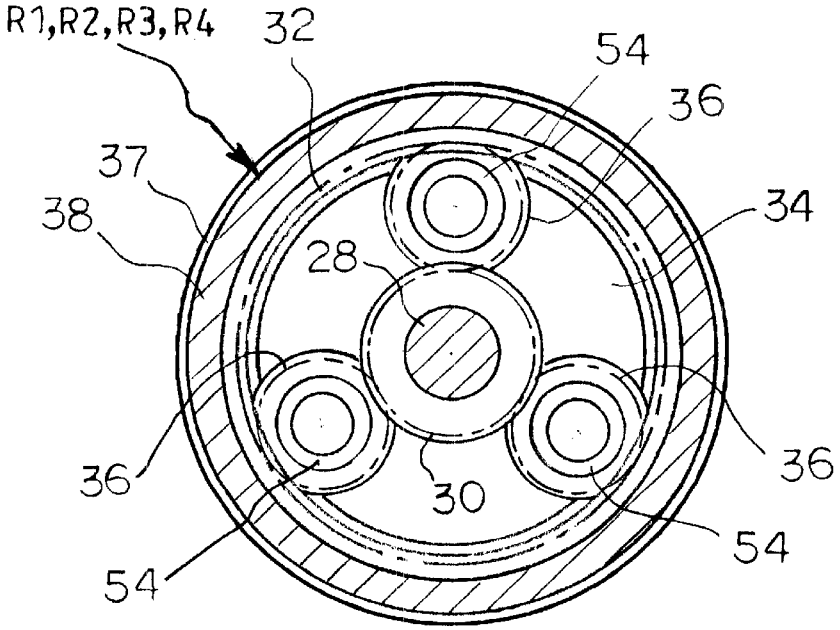
FIG. 5 is a view looking in the direction of arrows V in FIG. 3.
Figure 6:
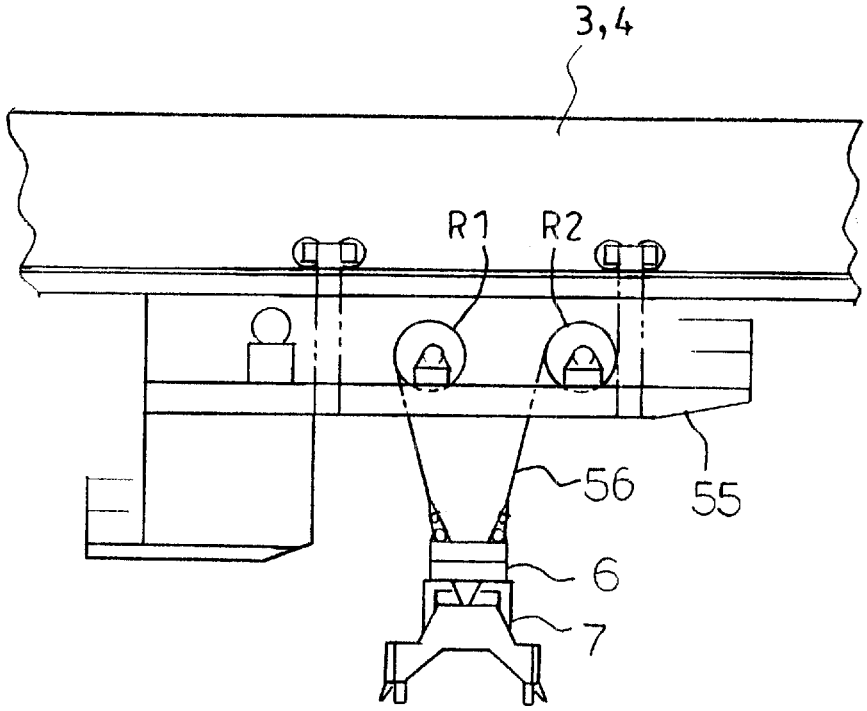
FIG. 6 is a right side elevation of a trolley with the drums shown in FIG. 3.
Figure 7:
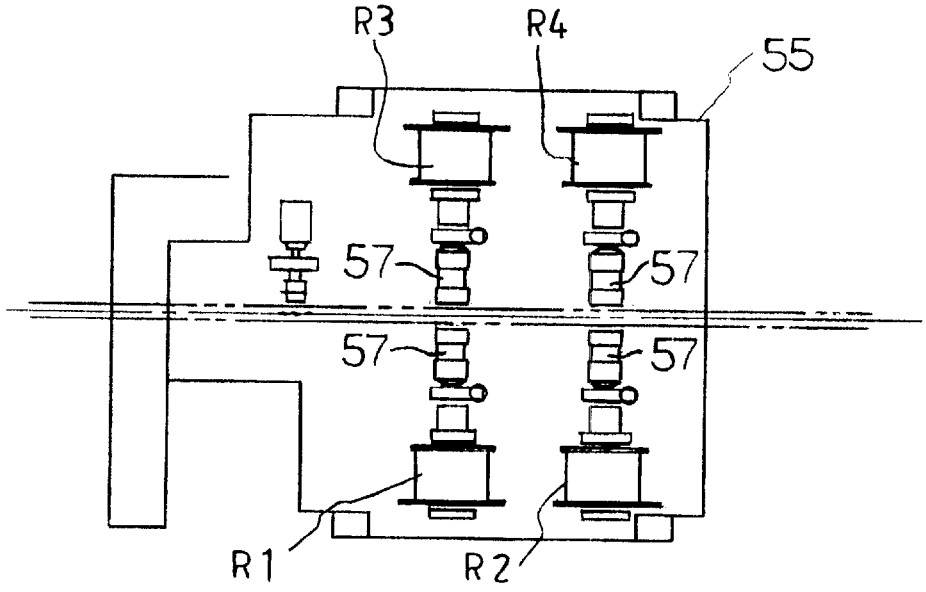
FIG. 7 is a plan view of the trolley shown in FIG. 6.
Figure 8:
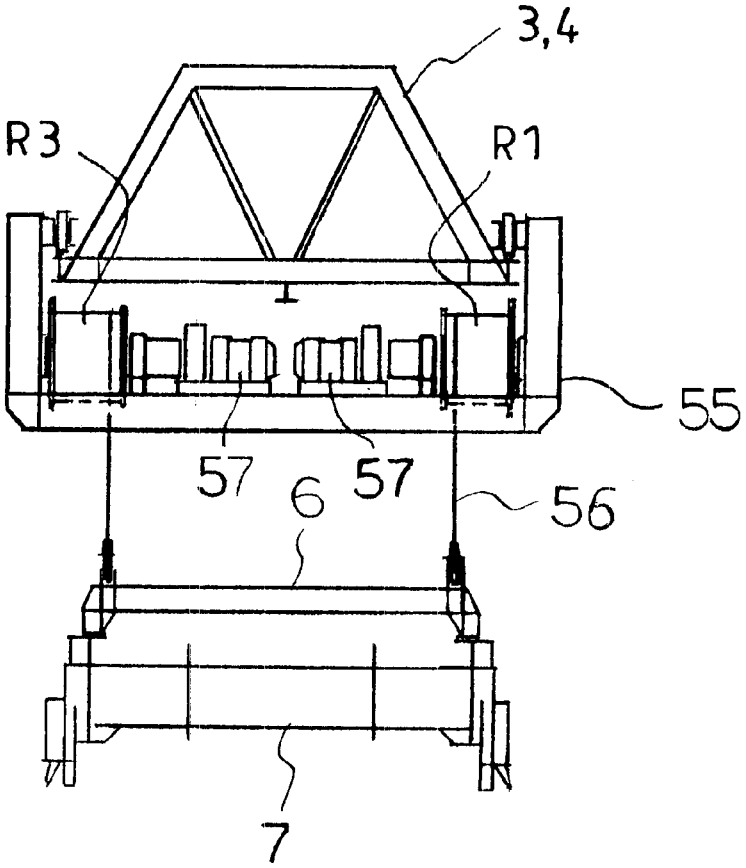
FIG. 8 is a rear view of the trolley shown in FIG. 6.

The first carrier 33 pivotally supports, as shown in FIG. 4, via bearings 53 three first planetary gears 35 which in turn are meshed with the first sun gear 29 and first internal teeth 31. The second carrier 34 pivotally supports, as shown in FIG. 5, via bearings 54 three second planetary gears 36 which in turn are meshed with the second sun gear 30 and the second internal teeth 32.

In the hoist shown in FIGS. 3 to 8, the drive source 57 is actuated so as to transmit its rotation power to the fixed shaft 26 via the drive shaft 25, the rotation shaft 27, the sun gear 29, the planetary gear 35, the carrier 33, the rotation shaft 28, the sun gear 30, the planetary gear 36 and the carrier 34.

In this case, however, since the drum body of each of the drums R1, R2, R3 and R4 is pivotally supported on the brackets 44 and 46 via the bearings 43 and 45 and the carrier 34 is constrained from peripheral displacement by the bracket 46 via the fixed shaft 26, the rotating power of the sun gear 30 is transmitted via the planetary gear 36 to the internal teeth 32 so that at the number of rotations corresponding to gear ratio of the internal teeth 32 to the sun gear 30, the drum body is rotated in the direction opposite to that of the sun gear 30.

The carrier 33 is relatively rotated in opposite direction to that of the drum body so that, at the number of rotations corresponding to gear ratio of the internal teeth 31 to the sun gear 29, the carrier 33 is rotated in the same direction as that of the sun gear 29.

As a result, with respect to the drive sources 57, the drums R1, R2, R3 and R4 are driven with reduced speed at the number of rotations corresponding to gear ratio of a first half of the speed reducing mechanism (which comprises the sun gear 29, the carrier 33, the planetary gear 35 and the internal teeth 31) and a second half of the speed reducing mechanism (which comprises the sun gear 30, the carrier 34, the planetary gear 36 and the internal teeth 32).

The drums R1, R2, R3 and R4 are installed at right land- and seaward positions and left land and seaward positions, respectively, on the trolley 55 which traverses along the girder 3 and boom 4 of the container crane (long beam of the loading and unloading facility).

Wound around each of the drums R1, R2, R3 and R4 is a head-block lifting rope 56. An unwound end of the rope 56 is locked on the head block 6 on which in turn the spreader 7 engageable with the container C (See FIG. 1) is mounted.

Therefore, concurrent actuation of the drive sources 57 of the drums R1, R2, R3 and R4 causes the drums R1, R2, R3 and R4 to be rotated in normal or reverse direction so that the ropes 56 are wound or unwound in association with the rotation of the drums R1, R2, R3 and R4. As a result, the head block 6 is lifted up or down relative to the trolley 55.

As described above, in the hoist shown in FIGS. 3 to 8, the rope 56 is wound on each of the drums R1, R2, R3 and R4, and the unwound end of the rope 56 is locked on the head block 6. Therefore, any increase in length of the ropes 56 and any increase in size of the drums R1, R2, R3 and R4 can be suppressed even when traversing distance of the trolley 55 is prolonged and/or the lift of the head block 6 is increased.

As a result, the head-block lifting ropes 56 can be made short in length and have no turns due to rope sheaves so that the ropes have improved durability, can undergo maintenance and inspection much easier and can be replaced with reduced cost, resulting in reduction of the running cost.

The entire hoist can be made light in weight and compact in size since each of the drums R1, R2, R3 and R4 has two sets of speed reducing mechanisms comprising the sun gears 29 and 30, the carriers 33 and 34, the planetary gears 35 and 36 and the internal teeth 31 and 32, respectively.

Each of the drums R1, R2, R3 and R4 is rotated by the independent drive source 57. As a result, the container C suspended via the head block 6 and the spreader 7 as shown in FIG. 1 can be maintained in proper posture by adjusting wound or unwound amount of each of the ropes 56. Moreover, the head block 6, the spreader 7 and the container C engaged with the spreader 7 can be refrained from being vibrated.

Figure 9:
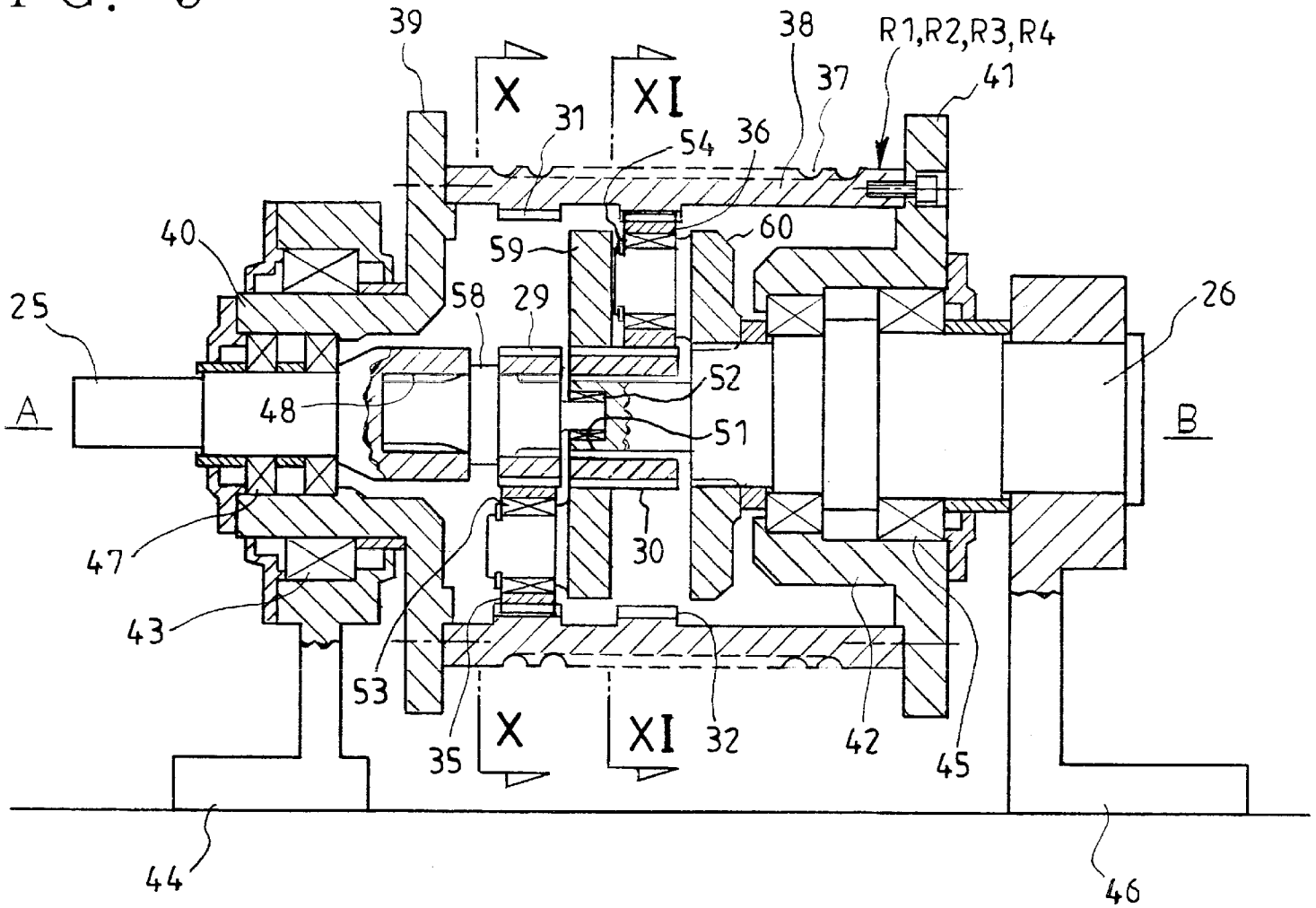
FIG. 9 is a sectional view of a drum using a variation of the speed reducing mechanism.
Figure 10:
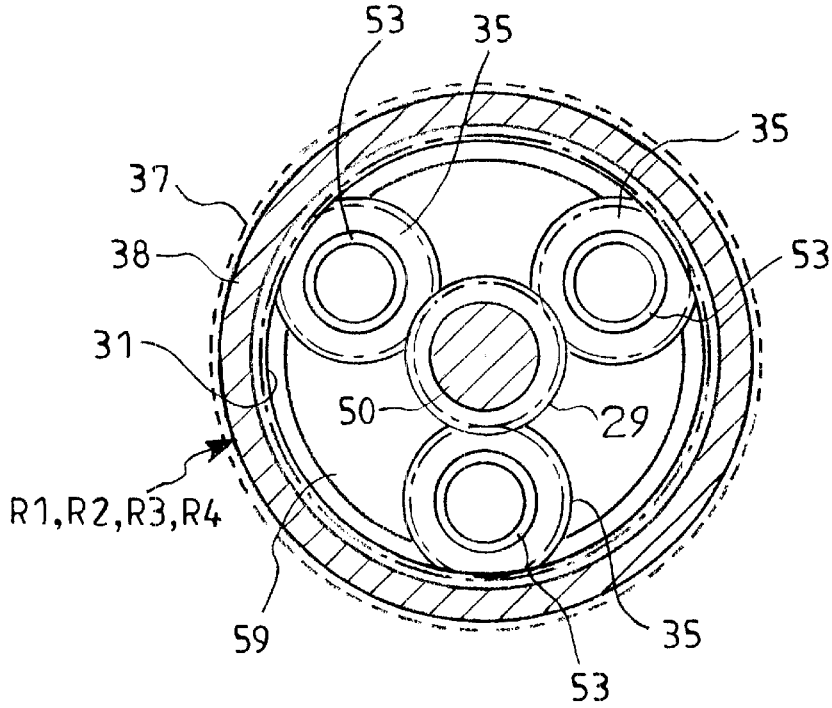
FIG. 10 is a view looking in the direction of arrows X in FIG. 9.
Figure 11:
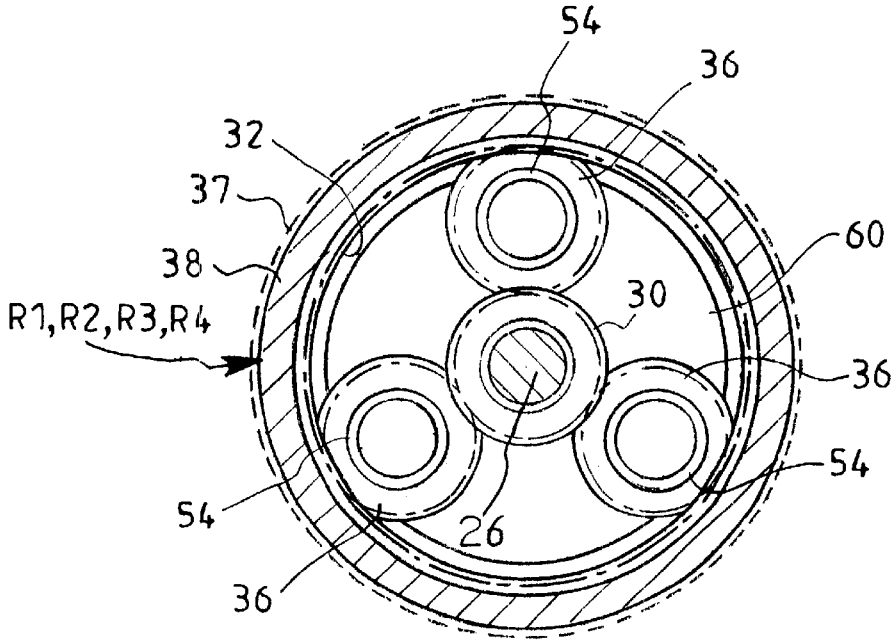
FIG. 11 is a view looking in the direction of arrows XI in FIG. 9.
Figure 12:
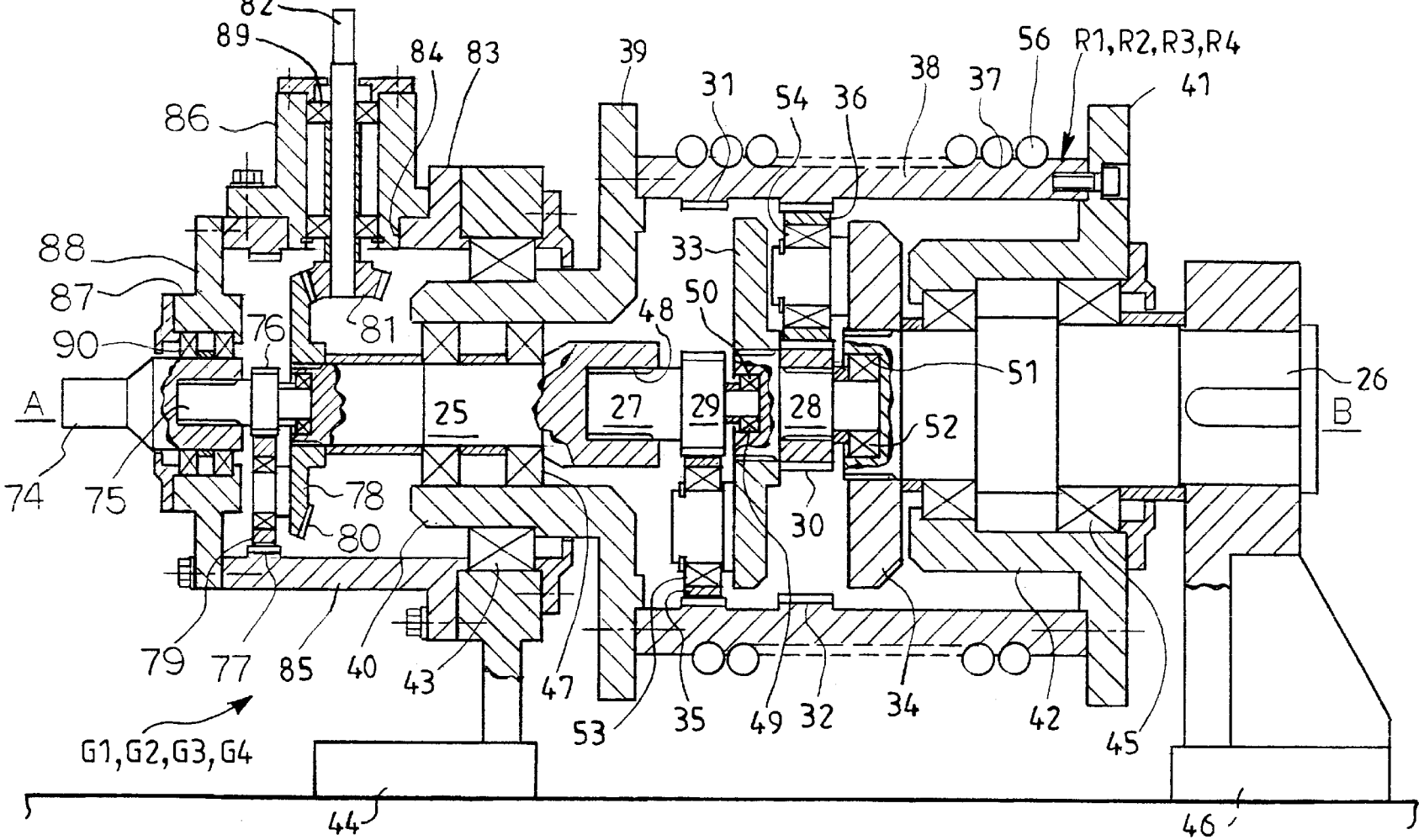
FIG. 12 is a sectional view of a drum and a planetary gear mechanism in a second embodiment of the invention.
Figure 13:
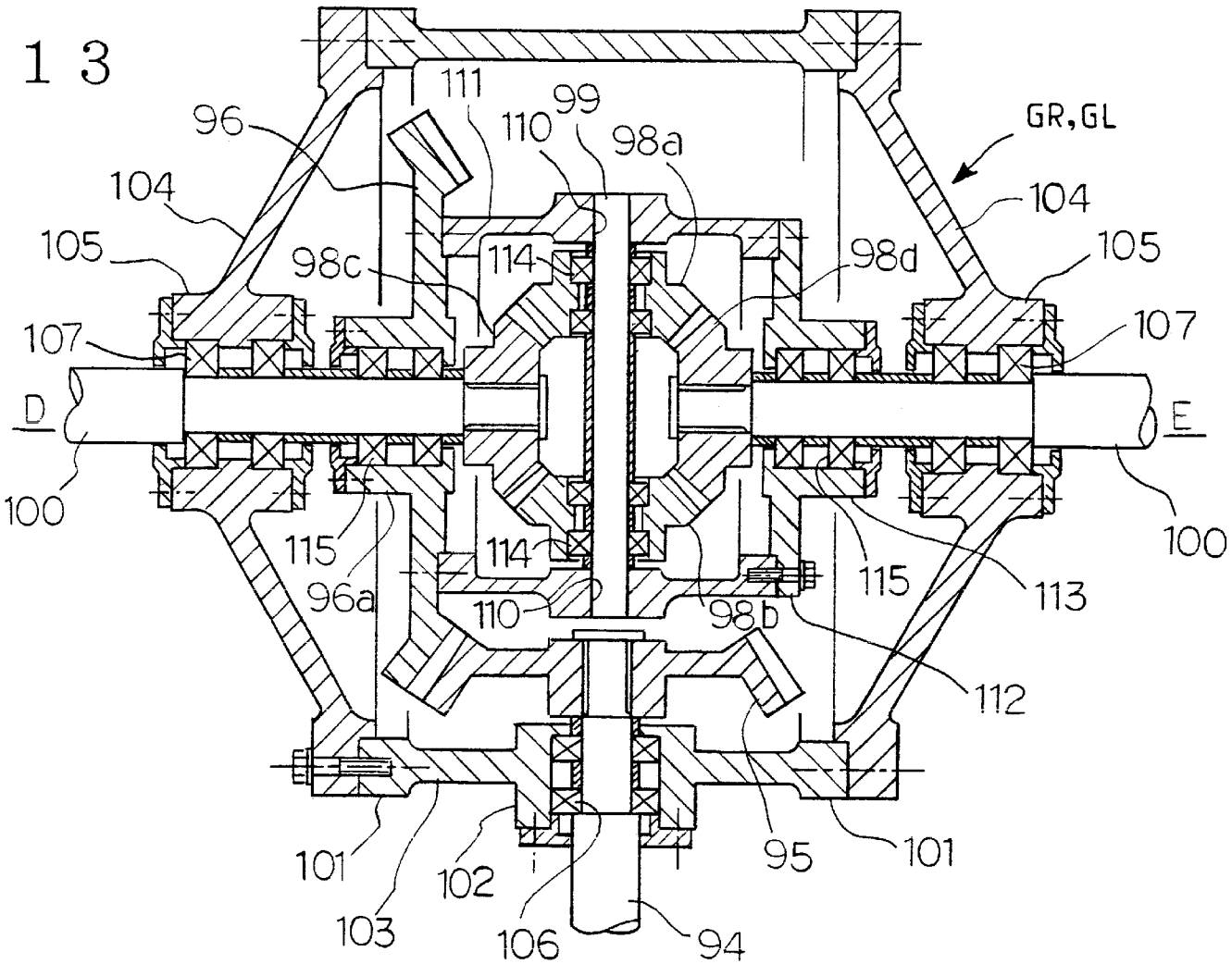
FIG. 13 is a sectional view of a differential gear mechanism in the second embodiment of the invention.
Figure 14:
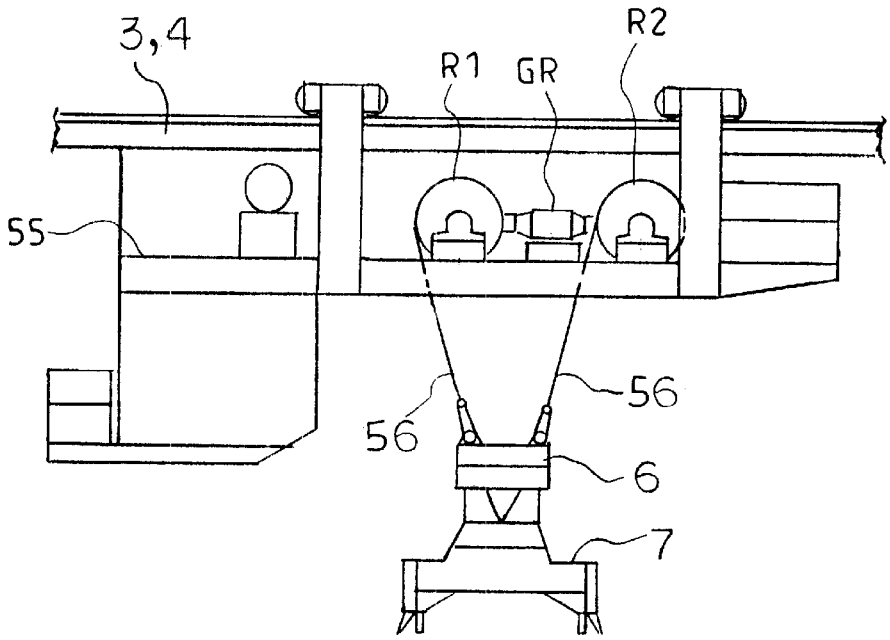
FIG. 14 is a right side elevation of the trolley with the drums of FIG. 12 and the differential gear mechanisms of FIG. 13.
Figure 15:
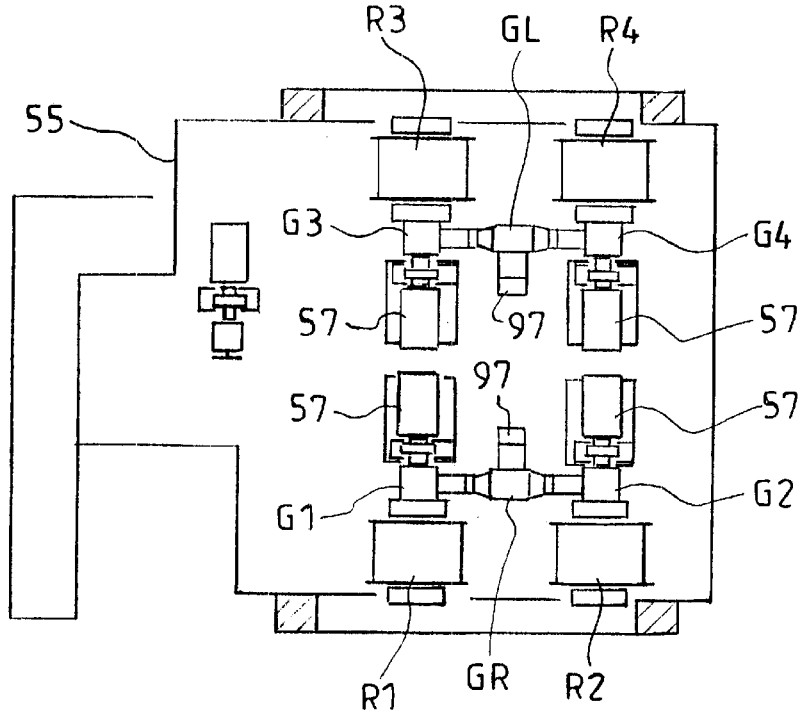
FIG. 15 is a plan view of the trolley shown in FIG. 14.
Figure 16:
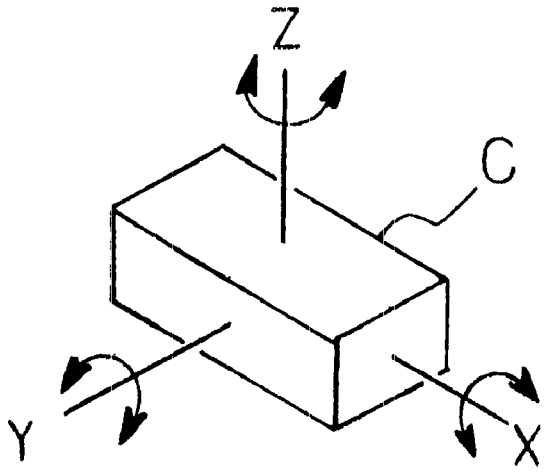
FIG. 16 is a diagram on posture of a container.
Figure 17:
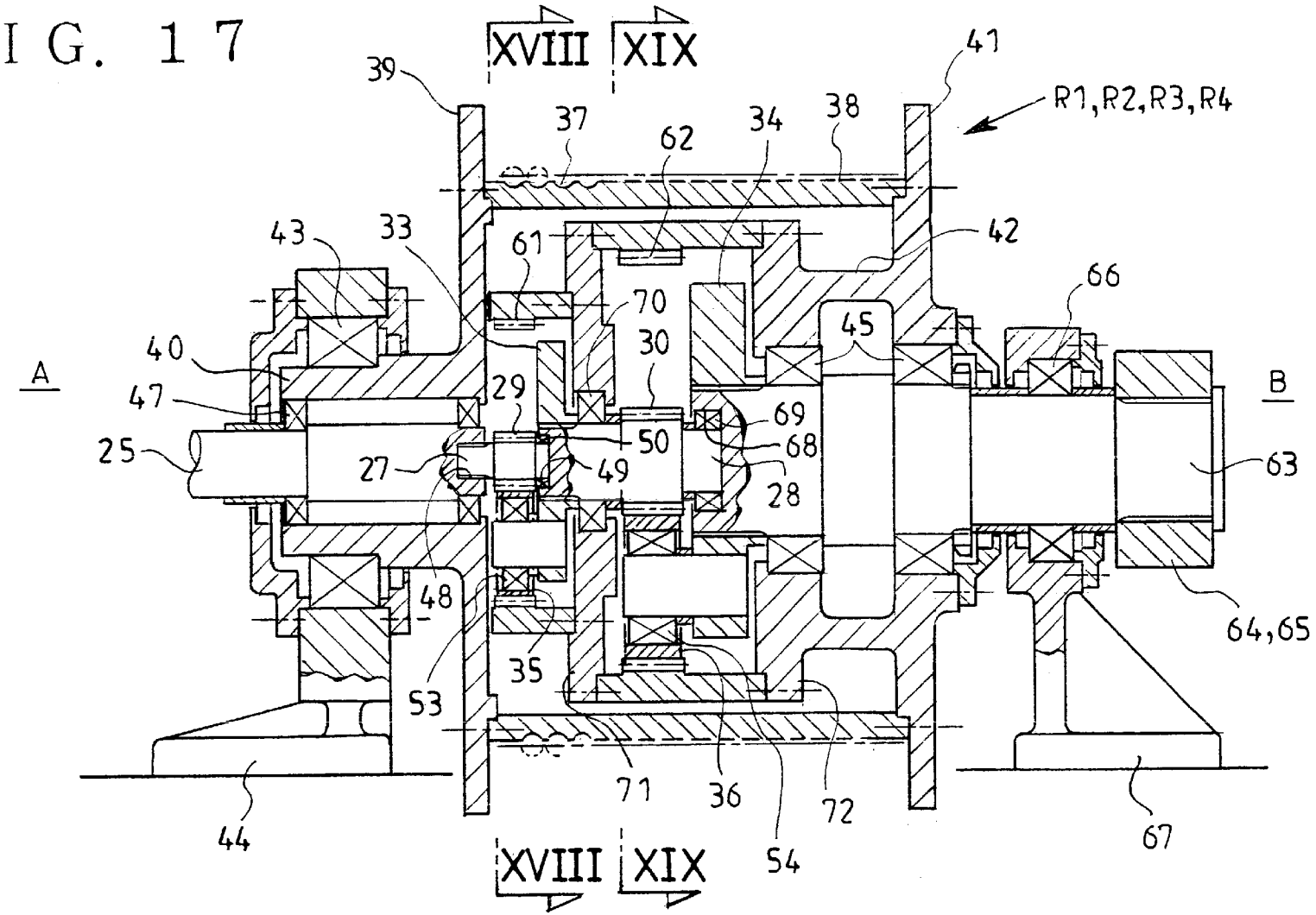
FIG. 17 is a sectional view showing a drum in a third embodiment of the invention.

FIGS. 9 to 11 represent a variation of speed reducing mechanism associated with the drums R1, R2, R3 and R4. In these figures, the same components as in FIGS. 3 to 8 are referred to by the same reference numerals.

This speed reducing mechanism for each of the drums R1, R2, R3 and R4 comprises a drive shaft 25 extending through one of openings of the drum and a fixed shaft 26 extending through the other opening coaxially of the shaft 25 as well as a rotation shaft 58, first and second sun gears 29 and 30, first and second internal teeth 31 and 32, first and second carriers 59 and 60 and first and second planetary gears 35 and 36 all of which are installed in the drum.

The drive shaft 25 is formed at its end facing to the side B with a recess 48 into which the rotation shaft 58 is coaxially fitted at its end facing to the side A. The rotation shaft 58 is coaxially fitted at its end facing to the side B, via a bearing 52, into a recess 51 formed on an end of the fixed shaft 26 facing to the side A so that the drive shaft 25 and the rotation shaft 58 can be peripherally rotated relative to the drum and to the fixed shaft 26.

The first sun gear 29 is fitted over a longitudinally intermediate portion of the rotation shaft 58 and the second sun gear 30 is loosely fitted over an end of the fixed shaft 26 facing to the side A.

The first carrier 59 is loosely fitted over an engaged portion of the drive shaft 25 with the fixed shaft 26 on the side B with respect to the first sun gear 29. The second sun gear 30 is fitted into the carrier 59 so as to be rotated integrally with the latter.

The second carrier 60 is loosely fitted over an intermediate portion of the fixed shaft 26 on the side B with respect to the second sun gear 30.

The first carrier 59 pivotally supports, as shown in FIG. 10, via bearings 53 three first planetary gears 35 which in turn are meshed with the first sun gear 29 and the first internal teeth 31. The second carrier 60 pivotally supports, as shown in FIG. 11, via bearings 54 three second planetary gears 36 which in turn are meshed with the second sun gear 30 and the second internal teeth 32.

In any of the drums R1, R2, R3 and R4 each using the speed reducing mechanism shown in FIGS. 9 to 11, the drive source is actuated so as to transmit its rotation power to the fixed shaft 26 via the shafts 25 and 58, the gears 29 and 35, the carrier 59, the gears 30 and 36 and the carrier 60.

In this case, however, since the drum body of each of the drums R1, R2, R3 and R4 is pivotally supported on the brackets 44 and 46 via bearings 43 and 45 and the carrier 34 is constrained from peripheral displacement by the bracket 46 via the fixed shaft 26, rotating power of the second sun gear 30 is transmitted via the planetary gear 36 to the internal teeth 32 so that at the number of rotations corresponding to the gear ratio of the internal teeth 32 to the sun gear 30, the drum body is rotated in the direction opposite to that of the sun gear 30.

The carrier 59 is relatively rotated in opposite direction to that of the drum body so that, at the number of rotations corresponding to gear ratio of the internal teeth 31 to the sun gear 29, the carrier 59 is rotated in the same direction as that of the sun gear 29.

As a result, with respect to the drive sources, the drums R1, R2, R3 and R4 are driven with reduced speed at the number of rotations corresponding to gear ratio of a first half of the speed reducing mechanism (which comprises the sun gear 29, the carrier 59, the planetary gear 35, the internal teeth 31) to a second half of the speed reducing mechanism (which comprises the sun gear 30, the carrier 60, the planetary gear 36 and the internal teeth 32).

FIGS. 12 to 16 represent a second embodiment of the invention in which the same components as in FIGS. 3 to 11 are referred to by the same reference numerals.

This hoist comprises first, second, third and fourth drums R1, R2, R3 and R4. Each of the drums comprises a drive shaft 25 extending through one of openings of the drum and a fixed shaft extending through the other opening of the drum coaxially of the drive shaft 25 as well as first and second rotation shafts 27 and 28, first and second sun gears 29 and 30, first and second internal teeth 31 and 32, first and second carriers 33 and 34, first and second planetary gears 35 and 36 all of which are installed in the drum. The drums R1, R2, R3 and R4 further comprise planetary gear mechanisms G1, G2, G3 and G4, respectively. Furthermore, a right-side differential gear mechanism GR is arranged for the drums R1 and R2 and a left-side differential gear mechanism GL, for the drums R3 and R4.

The drums R1, R2, R3 and R4 are installed at right land- and seaward positions and left land- and seaward positions, respectively, on a trolley 55 which traverses along a girder 3 and boom 4 of the container crane (long beam of the loading and unloading facility).

Wound around each of the drums R1, R2, R3 and R4 is a head-block lifting rope 56. An unwound end of the rope 56 is locked on a head block 6 on which in turn a spreader 7 engageable with the container C is mounted.

The planetary gear mechanisms G1, G2, G3 and G4 are disposed on the side A with respect to the brackets 44 which support the drums R1, R2, R3 and G4, respectively.

Each of the planetary gear mechanisms G1, G2, G3 and G4 comprises a cylindrical casing 85 with a bolted cover member 88 on the side A and with a flange 83 formed on the other side B, a drive shaft 74 extending through a hub 87 of the cover member 88, a bearing 90 inscribing the hub 87 and pivotally supporting the drive shaft 74, a tubular support seat 86 fitted in an opening 84 on an intermediate portion of the casing 85 and bolted to the casing 85, an input/output shaft 82 extending through the seat 86, a bearing 89 inscribing the seat 86 and pivotally supporting the shaft 82 as well as a rotation shaft 75, a sun gear 76, internal teeth 77, a carrier 78, a planetary gear 79 and large and small bevel gears 80 and 81 all of which are installed in the casing 85.

The flange 83 on the casing 85 is bolted to the bracket 44 so that the drive shaft 74 is positioned coaxially of the drive shaft 25 of the drum.

The rotation shaft 75 is coaxially fitted at its end facing to the side A into an end of the drive shaft 74 facing to the side B. The other end of the rotation shaft 75 facing to the side B is pivotally supported on the drive shaft 25 of the drum so as to be peripherally rotated. The sun gear 76 is fitted over an intermediate portion of the rotation shaft 75.

The internal teeth 77 are integrally formed on an inner surface of the casing 85 so as to surround the sun gear 76.

The carrier 78 is fitted over one end of the drive shaft 25 of the drum facing to the side A.

The planetary gear 79 is pivotally supported on one end of the carrier 78 facing to the side A so as to be meshed with the sun gear 76 and the internal teeth 77.

The large bevel gear 80 is integrally formed on a periphery of the carrier 78 facing to the side B.

The small bevel gear 81 is fitted over the input/output shaft 82 so as to be meshed with the large bevel gear 80.

Further, output shaft of a drive source 57 such as a motor having braking performance is connected to an end of the drive shaft 74 facing to the side A.

In any of the planetary gear mechanisms G1, G2, G3 and G4 as described above, rotating power of the drive source 57 is transmitted to the carrier 78 via the drive shaft 74, the rotation shaft 75, the sun gear 76 and the planetary gear 79 and the drive shaft 25 of the drum is rotated together with the carrier 78 at the number of rotations corresponding to gear ratio of the internal teeth 77 to the sun gear 76.

Moreover, the input/output shaft 82 is rotated at the number of rotations corresponding to gear ratio of the small bevel gear 81 to the large bevel gear 80.

Each of the right and left differential gear mechanisms GR and GL comprises a substantially cylindrical casing 103 with flanges 101 each formed on one and the other sides D and E and having a hub 102 at an intermediate portion of the casing, bearing housings 105 each having a conical flange 104 coaxially bolted to the flange 101 of the casing 103, a drive shaft 94 extending through the hub 102 of the casing 103, a bearing 106 inscribing the hub 102 and pivotally supporting the drive shaft 94, a small bevel gear 95 positioned in the casing 103 and fitted over a tip of the drive shaft 94, output shafts 100 extending through the bearing housings 105 in a direction perpendicular to the drive shaft 94, bearings 107 each inscribing the bearing housing 105 and pivotally supporting the output shaft 100, a large bevel gear 96 with a boss 96*a* fitted over the shaft 100 on the side D via a bearing 115 and meshed with the small bevel gear 95, a cover member 112 having a boss 113 fitted over the output shaft 100 on the other side E via a bearing 115, a gear box 111 positioned between and bolted to the bevel gear 96 and the cover member 112, a support shaft 99 extending in a direction perpendicular to the output shafts 100 and fitted at their opposite ends into openings 110 formed on the gear box 111, bevel gears 98*a* and 98*b* pivotally supported on the support shaft 99 via bearings 114 and bevel gears 98*c* and 98*d* each fitted over a tip of the output shaft 100 and meshed with the bevel gears 98*a* and 98*b*.

The right differential gear mechanism GR is installed between the drums R1 and R2 on the trolley 55 and its output shafts 100 are connected to the input/output shaft 82*s* of the planetary gear mechanisms G1 and G2.

The left differential gear mechanism GL is installed between the drums R3 and R4 on the trolley 55 and its output shafts 100 are connected to the input/output shafts 82 of the planetary gear mechanisms G3 and G4.

Further, the drive shaft 94 of each of the differential gear mechanisms GR and GL is connected at its base end with an output shaft of a differential-gear drive source 97 such as a motor having braking performance.

In each of the differential gear mechanisms GR and GL as disclosed above, rotating power of the drive source 97 is transmitted to each of the output shafts 100 via the drive shaft 94, the bevel gears 95 and 96, the gear box 111 and the bevel gears 98*a*, 98*b*, 98*c* and 98*d*, so that the input/output shafts 82 of the planetary gear mechanisms is rotated together with the output shafts 100.

When rotation of the output shaft of the drive source 97 is braked, the output shafts 100 are interlocked with each other so that the input/output shafts 82 of the planetary gear mechanisms are rotated in synchronization.

In the hoist shown in FIGS. 12 to 16, actuation of the drive sources 57 for rotation of the drums R1, R2, R3 and R4 in normal or reverse direction causes the ropes 56 to be wound or unwound so that the head block 6 is lifted up or down relative to the trolley 55.

In this case, if the rotation of the output shaft of the drive source 97 for the right differential gear mechanism GR is braked, the output shafts 100 of the gear mechanism GR with which the input/output shafts 82 of the planetary gear mechanisms G1 and G2 are connected are interlocked with each other, which causes the drums R1 and R2 to be rotated at equal speed so that wound or unwound amounts of the ropes 56 of the drums R1 and R2 agree with each other.

If the rotation of the output shaft of the drive source 97 for the left differential gear mechanism GL is braked, the output shafts 100 of the gear mechanism GL with which the input/output shafts 82 of the planetary gear mechanisms G3 and G4 are connected are interlocked with each other, which causes the drums R3 and R4 to be rotated at equal speed so that wound or unwound amounts of the ropes 56 of the drums R3 and R4 agree with each other.

If the braking of the output of the drive source 97 for the right differential gear mechanism GR is released, the drums R1 and R2 are driven at different numbers of rotations by the independent drive sources 57, respectively. Similarly, if the braking of the output shaft of the drive source 97 for the left differential gear mechanism GL is released, the drums R3 and R4 are driven at different numbers of rotations by the independent drive sources 57, respectively. As a result, wound or unwound amounts of the ropes 56 for the drums R1, R2, R3 and R4 may be adjusted independently with each other to maintain the container C suspended via the head block 6 and the spreader 7 in proper posture.

Further, when the respective drive sources 97 are properly operated while the braking of the output shafts of the drive sources 97 is released, relative number of rotations of the drums R1 and R2 installed on the right side of the trolley 55 and relative number of rotations of the drums R3 and R4 installed on the left side of the trolley 55 can be changed with fine adjustment. As a result, fine adjustment for the posture of the container C can be made which is suspended via the head block 6 and the spreader 7.

More specifically, when the container C is to be lifted up or down without controlling the posture of the container C, the drive sources 97 of the differential gear mechanisms GR and GL are braked to constrain the rotation of the drive sources 97 while the brakes of the drums R1, R2, R3 and R4 are released, Under such conditions, the drive sources 57 for the drums are rotated in the same direction.

As a result, the drums R1 and R2 are rotated in synchronization and a wound/unwound amount of the headblock-lifting rope 56 for the drum R1 agrees with that of the rope 56 for the drum R2 while the drums R3 and R4 are rotated in synchronization and a wound/unwound amount of the head-block-lifting rope 56 for the drum R3 agrees with that of the rope 56 for the drum R4. Thus, the container C is lifter up or down.

When list (tilt about horizontal axis X in FIG. 16) of the container C is to be controlled, for example the brakes of the drive sources 97 of the differential gear mechanisms GR and GL are released to allow the rotation of the drive sources 97 and the drive sources 57 for the drums R2 and R4 are braked to constrain the rotation of the drive sources 57 for the drums R2 and R4 while the brakes of the drive sources 57 for the drums R1 and R3 are released. In such conditions, the drive sources 57 for the drums R1 and R3 are rotated in the same direction.

As a result, the drums R1 and R3 are rotated to wind or unwind the head-block-lifting ropes 56 for the drums R1 and R3 so that the posture of the container C is controlled.

When trim (tilt about horizontal axis Y in FIG. 16) of the container C is to be controlled, for example the brakes of the drive sources 97 of the differential gear mechanisms GR and GL are released to allow the rotation of the drive sources 97 and, with the brakes of the drive sources 57 for the drums R1, R2, R3 and R4 being released, the drive sources 57 for the drums R1 and R2 are rotated in the same direction while the drive sources 57 for the drums R3 and R4 are rotated in a direction reverse to the rotation direction of the drive sources 57 for the drums R1 and R2.

As a result, the drums R1 and R2 are rotated to wind or unwind the head-block-lifting ropes 56 for the drums R1 and R2 while the drums R3 and R4 are rotated in a direction reverse to that of the drums R1 and R2 to unwind or wind the ropes 56 for the drums R3 and R4 so that the posture of the container C is controlled.

When skew (rotation about vertical axis Z in FIG. 16) of the container C is to be controlled, for example the brakes of the drive sources 97 of the differential gear mechanisms GR and GL are released to allow the rotation of the drive sources 97 and the drive sources 57 for the drums R2 and R3 are braked to constrain the rotation of the drive sources 57 for the drums R2 and R3 while the brakes of the drive sources 57 for the drums R1 and R4 are released. In such conditions, the drive sources 57 for the drums R1 and R4 are rotated in the same direction.

As a result, the drums R1 and R4 are rotated to wind or unwind the head-block-lifting ropes 56 for the drums R1 and R4 so that the posture of the container C is controlled.

When any swinging of the container C in the traverse direction (i.e., the direction of the axis X in FIG. 16) is to be suppressed, for example, just like the case of the above-mentioned list control of the container C, the ropes 56 for the drums R1 and R3 are wound or unwound while, to the contrary, the ropes 56 for the drums R2 and R4 are unwound or wound, so that horizontal center of gravity of the container C is controlled.

When any swinging of the container C in the skew direction is to be suppressed, for example, just like the case of the above-mentioned skew control of the container C, the ropes 56 for the drums R1 and R4 are wound or unwound to control rotary moment of the container C.

FIGS. 17 to 22 represent a third embodiment of the present invention. In the figures, the same components as in FIGS. 3 to 16 are referred to by the same reference numerals.

This hoist comprises first, second, third and fourth drum R1, R2, R3 and R4. Each of the drums comprises a drive shaft 25 extending through one of openings of the drum and a torque arm shaft 63 extending through the other opening of the drum coaxially of the drive shaft 25 as well as first and second rotation shafts 27 and 28, first and second sun gears 29 and 30, first and second internal tooth ring 61 and 62, first and second carrier 33 and 34, first and second planetary gears 35 and 36 all of which are installed in the drum. The hoist further comprises torque arms 64 and 65, link mechanisms L and cylinders 73.

Each of the drums R1, R2, R3 and R4 is pivotally supported for peripheral rotation by a bearing 43 which circumscribes a journal 40, a bracket 44 in which the bearing 43 is fitted, a bearing 45 which inscribes a hub 42 and circumscribes the torque arm shaft 63 and a bracket 67 in which a bearing 66 is fitted to circumscribe an end portion of the torque arm shaft 63 closer to outer end of the drum.

Separate head-block-lifting ropes 56 are wound around the drums R1 and R3 and around the drums R2 and R4 in mutually opposite directions with respect to axes of the drums.

Unwound ends of the ropes 56 suspended from the drums R1 and R3 are locked on a landward end of the head block 6 while unwound ends of the ropes 56 suspended from the drums R2 and R4 are locked on a seaward end of the head block 6.

The drive shaft 25 is connected at its end facing to the side A to an output shaft of the drive source 57, It is set such that rotation of the drive sources 57 for the drums R1 and R3 in normal or reverse direction is opposite that for the drums R2 and R4.

The second rotation shaft 28 extends at its end facing to the side B into a recess 6, formed on an end of the torque arm shaft 63 facing to the side A via a bearing 69 so that the second rotation shaft 28 can be peripherally rotated with respect to the first rotation shaft 27 and the torque arm,shaft 63.

The first internal tooth ring 61 is arranged to peripherally enclose the first sun gear 29 and is bolted to a disk 71 which is pivotally supported on the second rotation shaft 28 via a bearing 70.

The second internal tooth ring 62 is arranged to peripherally enclose the second sun gear 30 and is bolted to the disk 71 and to a flange 72 continuous with a hub 42.

Figure 18:
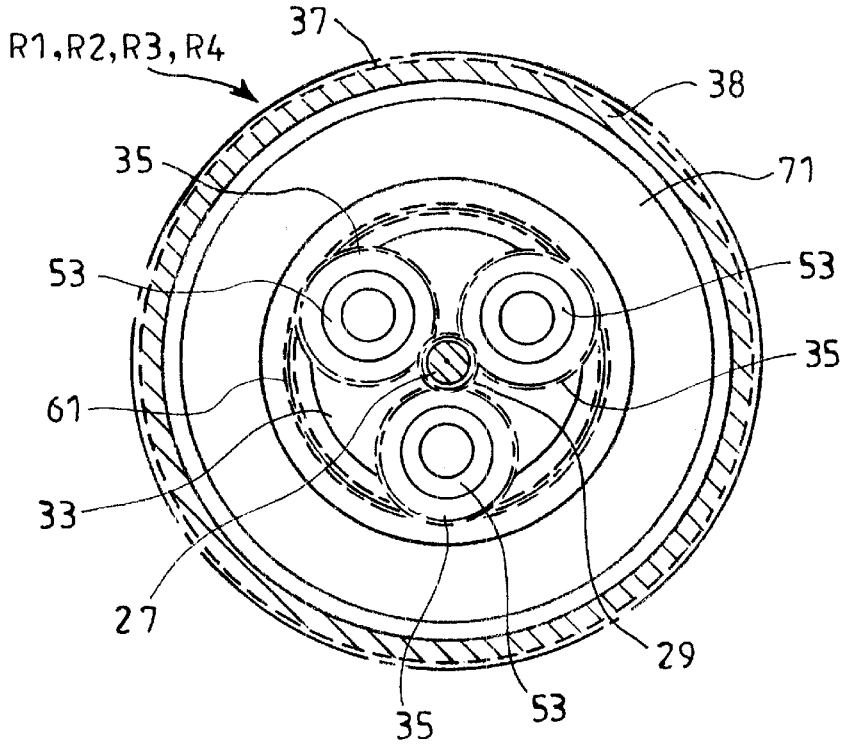
FIG. 18 is a view looking in the direction of arrows XVIII in FIG. 17.

The first carrier 33 pivotally supports, as shown in FIG. 18, via bearings 53 three first planetary gears 35 which are meshed with the first sun gear 29 and with the first internal tooth ring 61.

Figure 19:
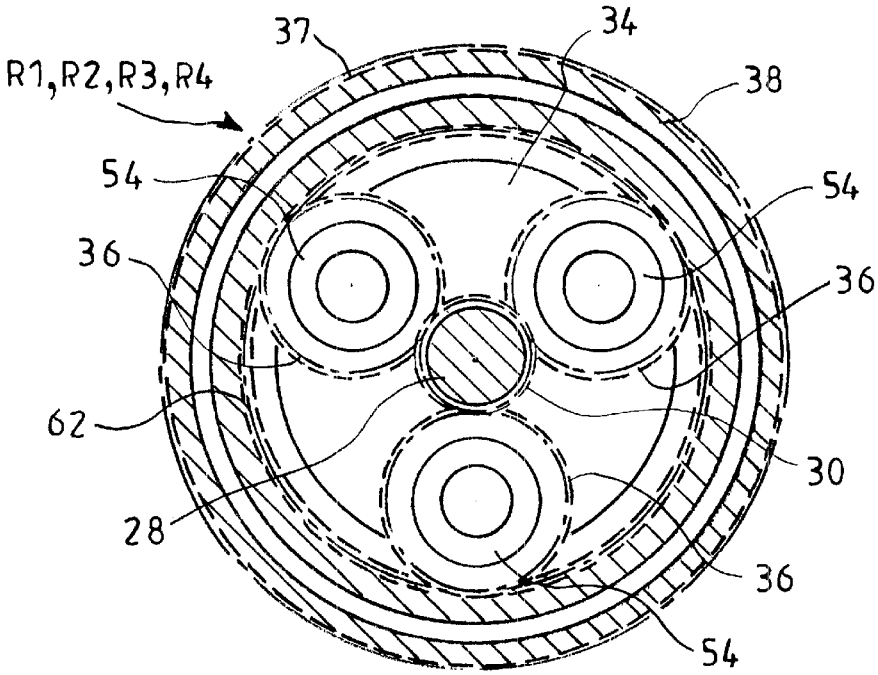
FIG. 19 is a view looking in the direction of arrows XIX in FIG. 17.

The second carrier 34 is fitted to an end of the torque arm shaft 63 facing to the side A. The second carrier 34 pivotally supports, as shown in FIG. 19, via bearings 54 three second planetary gears 36 which are meshed with the second sun gear 30 and with the second internal tooth ring 62.

The torque arm 64 is mounted on an end of the torque arm shaft 63 of each of the drums R1 and R3 facing to the side B such that its tip end is directed downward.

The torque arm 65 is mounted on an end of the torque arm shaft 63 of each of the drums R2 and R4 facing to the side B such that it is in parallel with the torque arm 64 and its tip end is directed downward.

The link mechanism L comprises a lever 22 positioned between the drums R1 and R2 or the drums R3 and R4 and having its upper end pivoted to a beam 21 on the trolley 55, a pair of first links 23 pivoted to an intermediate portion of the lever 22 with their base ends overlapped, and a pair of second links 24 each connected at its one end via load cell 91 to a tip end of the corresponding first link 23 and pivoted at its other end to the tip end of the torque arm 64 or 65.

The cylinder 73 has its piston rod pivoted to a lower end of the lever 22 and is pivotally supported on the trolley 55 such that its housing is approximately in parallel with the first links 23. Expansion and contraction of the cylinder 73 causes the first links 23 to be displaced in landward or seaward direction.

In the hoist shown in FIGS. 17 to 22, the drive source 57 is actuated so as to transmit its rotation power to the torque arm shaft 63 via the drive shaft 25, the first rotation shaft 27, the first sun gear 29, the first planetary gear 35, the first carrier 33, the second rotation shaft 28, the second sun gear 30, the second planetary gear 36 and the second carrier 34.

In this case, however, the drum body of each of the drums R1, R2, R3 and R4 is pivotally supported on the brackets 44 and 67 via the bearings 43 and 66 and the second carrier 34 is constrained from peripheral displacement by the cylinder 73 via the torque arm shaft 63 and the torque arms 64 and 65. As a result, rotation power of the second sun gear 30 is transmitted via the planetary gear 36 to the second internal tooth ring 62 so that the drum body is rotated in a direction opposite to that of the second sun gear 30 at the number of rotations corresponding to gear ratio of the second internal tooth ring 62 to the second sun gear 30.

Also, since the first carrier 33 is rotated relatively in reverse direction to that of the drum, the first carrier 33 is rotated in the same direction as that of the first sun gear 29 at the number of rotations corresponding to gear ratio of the first internal tooth ring 61 to the first sun gear 29.

As a result, with respect to the drive source 57, the drums R1, R2, R3 and R4 are driven with reduced speed at the number of rotations corresponding to gear ratio of a first half of the speed reducing mechanism (which comprises the sun gear 29, the carrier 33, the planetary gear 35 and the internal tooth ring 61) and a second half of the speed reducing mechanism (which comprises the sun gear 30, the carrier 34, the planetary gear 36 and the internal tooth ring 62).

Further, since rotation of the drive sources 57 for the drums R1 and R3 in normal or reverse direction is set opposite to that for the drums 12 and R4 in normal or reverse direction, the drums R1 and R3 and the drums R2 and R4 are differently rotated from one another in axes of the drums.

As a result, the ropes 56 are wound around or unwound from the drums R1, R2, R3 and R4 and the head block 6 is moved up or down.

Figure 20:
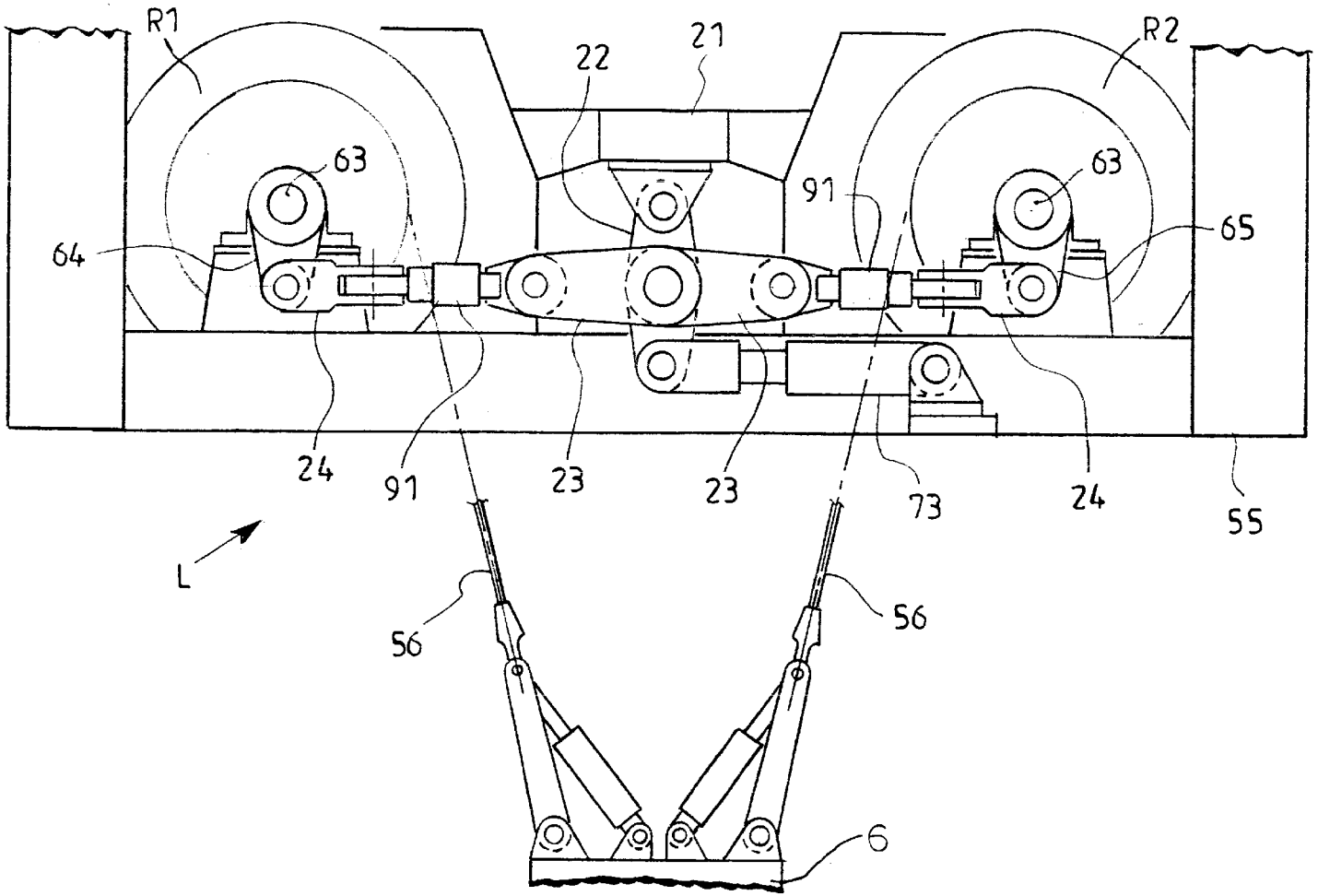
FIG. 20 is a right side elevation of a link-mechanism in a third embodiment of the invention.
Figure 21:
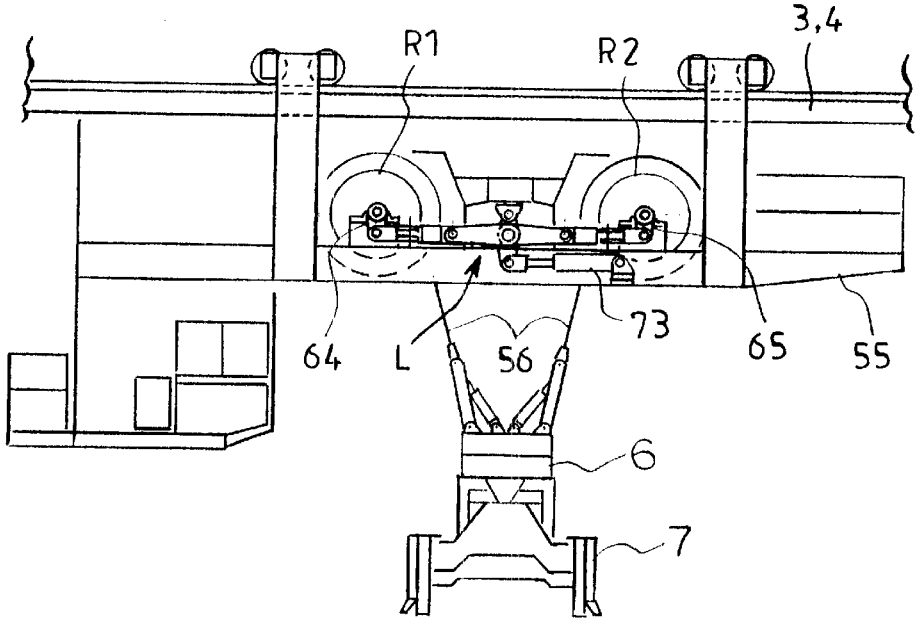
FIG. 21 is a right side elevation of a trolley with the drums of FIG. 17 and the link mechanisms of FIG. 20.
Figure 22:
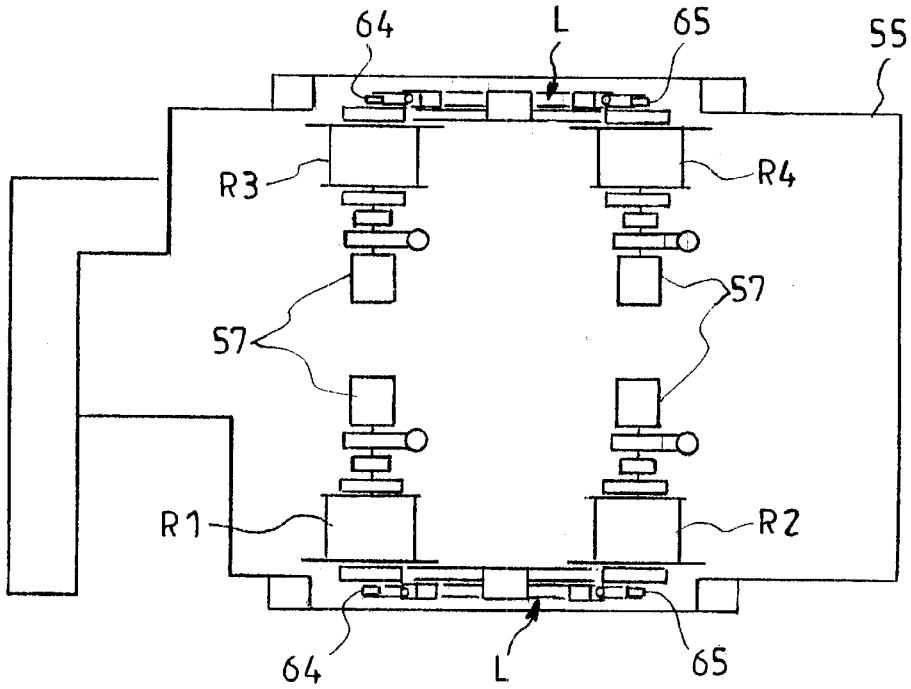
FIG. 22 is a plan view of the trolley shown in FIG. 21.

When the trolley 55 not in operation is to be traversed in a seaward direction or when the trolley traversing in a landward direction is to be stopped, fluid pressure is applied to a head-side fluid chamber of the cylinder 73 so that the cylinder 73 is expanded. As shown in FIG. 20, the expansion of the cylinder 73 is transmitted from the first and second links 23 and 24 to the torque arms 64 and 65 so that the torque arms 64 and 65 are rotated clockwise in FIG. 20 via the links 23 and 24. As a result, a rotating power is transmitted to the drums R1, R2, R3, and R4 via the torque arm 63, the carrier 34, the planetary gear 36 and the internal tooth ring 62, and the head-block lifting ropes 56 locked on the seaward end of the head block 6 are wound up on the drums R2 and R4 while the ropes 56 locked on the landward end of the head block 6 are unwound from the drums R1 and R3.

As a result, tensions on these ropes 56 are adjusted to apply a force directed in seaward direction on the head block 6, which can suppress any swinging of the head block 6 caused by traversing or stopping of the trolley 55.

When the trolley 55 not in operation is accelerated to be traversed in the landward direction or when the trolley 55 traversing in the seaward direction is decelerated to be stopped, fluid pressure is applied to a rod-side fluid chamber of the cylinder 73 so that the cylinder 73 is contracted. As shown in FIG. 20, the contraction of the cylinder 73 is transmitted from the first and second links 23 and 24 to the torque arms 64 and 65 so that the torque arms 64 and 65 are rotated counterclockwise in FIG. 20 via the links 23 and 24. As a result, a rotating power is transmitted to the drums R1, R2, R3, and R4 via the torque arm shaft 63, the carrier 34, the planetary gear 36, and the internal tooth ring 62. The head-block lifting ropes 56 locked on the seaward end of the head block 6 are unwound from the drums R2 and R4, and the ropes 56 locked on the landward end of the head block 6 are wound up on the drums R1 and R3.

As a result, tensions of the these ropes 56 are adjusted to apply a force directed in the landward direction on the head block 6, which can suppress any swinging of the head block 6 caused by traversing or stopping of the trolley 55.

What is claimed is:

1. A hoist comprising:

a trolley configured to traverse a beam of a loading and unloading facility;

at least a pair of first and second drums respectively installed on opposite sides of the trolley;

independent drive sources configured to drive separately each of said first and second drums via an output shaft on each of the independent drive sources, each drum including, first and second sun gears disposed coaxially in and at opposite ends of said drum, the first sun gear in each drum connected to one of the independent drive sources, first and second sun gear carriers each disposed ahead of a corresponding sun gear in each drum and rotatably arranged on ends of the first and second sun gears, respectively, planetary gears pivotally supported on each of said first and second sun gear carriers and meshed with the corresponding sun gear, and internal teeth rings arranged coaxially so as to peripherally enclose the sun gears and meshed with said first and second sun gear carriers, said rings disposed in each drum so as to be integrally rotated with each drum and meshed with said planetary gears;

paired first and second torque arms, each torque arm having a base end connected to one of the second sun gear carriers in said first and second drums and extending radially of the drums, said paired first and second torque arms parallel with each other and configured to impart a rotation to said second sun gear carriers in said first and second drums and thereby rotate said first and second drums;

a link mechanism having one end pivoted to a tip end opposite said base end of the first torque arm and having another end pivoted to a tip end of the second torque arm;

an actuator configured to displace the link mechanism axially thereof; and lifting ropes wound around respective of said first and second drums in mutually opposite directions about axes of the drums, each of said first and second drums having an unwound end locked on a suspension piece of a container.

* * * * *